US008810456B2

(12) United States Patent
Kato

(10) Patent No.: US 8,810,456 B2
(45) Date of Patent: Aug. 19, 2014

(54) WIRELESS IC DEVICE AND COUPLING METHOD FOR POWER FEEDING CIRCUIT AND RADIATION PLATE

(75) Inventor: Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 372 days.

(21) Appl. No.: 13/325,273

(22) Filed: Dec. 14, 2011

(65) Prior Publication Data

US 2012/0086526 A1 Apr. 12, 2012

Related U.S. Application Data

(63) Continuation of application No. PCT/JP2010/057668, filed on Apr. 30, 2010.

(30) Foreign Application Priority Data

Jun. 19, 2009 (JP) ..... 2009-147060
Oct. 7, 2009 (JP) ..... 2009-233195

(51) Int. Cl.
*H01Q 1/38* (2006.01)
*H01Q 9/28* (2006.01)
*H01Q 7/00* (2006.01)
*H01Q 1/22* (2006.01)

(52) U.S. Cl.
CPC ..... *H01Q 1/2225* (2013.01); *H01Q 1/38* (2013.01); *H01Q 9/285* (2013.01); *H01Q 7/00* (2013.01)
USPC ..... 343/700 MS; 343/850; 343/895

(58) Field of Classification Search
CPC ..... H01Q 1/2208; H01Q 1/2225; H01Q 7/00; H01Q 1/38
USPC ..... 343/850, 700 MS, 895
See application file for complete search history.

(56) References Cited

U.S. PATENT DOCUMENTS 3,364,564 A 1/1968 Kurtz et al.
4,794,397 A 12/1988 Ohe et al.

(Continued)

FOREIGN PATENT DOCUMENTS

CA 2 279 176 A1 7/1998
DE 10 2006 057 369 A1 6/2008

(Continued)

OTHER PUBLICATIONS

Official Communication issued in International Patent Application No. PCT/JP2009/069486, mailed on Mar. 2, 2010.

(Continued)

*Primary Examiner* — Hoang V Nguyen
(74) *Attorney, Agent, or Firm* — Keating & Bennett, LLP

(57) ABSTRACT

A wireless IC device includes a wireless IC chip, a power feeding circuit substrate including a power feeding circuit including inductance elements, and radiation plates including plate-shaped coupling units. The inductance elements have spiral shapes and are wound in directions opposite to each other. The plate-shaped coupling units in the radiation plates are disposed in a vicinity of the inductance elements so as to be perpendicular or substantially perpendicular to the winding axes of the inductance elements, and eddy currents occur in the plate-shaped coupling units so as to couple the power feeding circuit and the radiation plates with each other. The plate-shaped coupling units may also have spiral shapes.

4 Claims, 13 Drawing Sheets

(56) References Cited

U.S. PATENT DOCUMENTS 5,232,765 A 8/1993 Yano et al.
5,253,969 A 10/1993 Richert
5,337,063 A 8/1994 Takahira
5,374,937 A 12/1994 Tsunekawa et al.
5,399,060 A 3/1995 Richert
5,491,483 A 2/1996 D'Hont
5,528,222 A 6/1996 Moskowitz et al.
5,757,074 A 5/1998 Matloubian et al.
5,854,480 A 12/1998 Noto
5,903,239 A 5/1999 Takahashi et al.
5,936,150 A 8/1999 Kobrin et al.
5,955,723 A 9/1999 Reiner
5,995,006 A 11/1999 Walsh
6,104,611 A 8/2000 Glover et al.
6,107,920 A 8/2000 Eberhardt et al.
6,172,608 B1 1/2001 Cole
6,181,287 B1 1/2001 Beigel
6,190,942 B1 2/2001 Wilm et al.
6,249,258 B1 6/2001 Bloch et al.
6,259,369 B1 7/2001 Monico
6,271,803 B1 8/2001 Watanabe et al.
6,335,686 B1 1/2002 Goff et al.
6,362,784 B1 3/2002 Kane et al.
6,367,143 B1 4/2002 Sugimura
6,378,774 B1 4/2002 Emori et al.
6,406,990 B1 6/2002 Kawai
6,448,874 B1 9/2002 Shiino et al.
6,452,563 B1 9/2002 Porte
6,462,716 B1 10/2002 Kushihi
6,542,050 B1 4/2003 Arai et al.
6,600,459 B2 7/2003 Yokoshima et al.
6,634,564 B2 10/2003 Kuramochi
6,664,645 B2 12/2003 Kawai
6,763,254 B2 7/2004 Nishikawa
6,812,707 B2 11/2004 Yonezawa et al.
6,828,881 B2 12/2004 Mizutani et al.
6,837,438 B1 1/2005 Takasugi et al.
6,861,731 B2 3/2005 Buijsman et al.
6,927,738 B2 8/2005 Senba et al.
6,963,729 B2 11/2005 Uozumi
7,088,249 B2 8/2006 Senba et al.
7,088,307 B2 8/2006 Imaizumi
7,112,952 B2 9/2006 Arai et al.
7,119,693 B1 10/2006 Devilbiss
7,129,834 B2 10/2006 Naruse et al.
7,248,221 B2 7/2007 Kai et al.
7,250,910 B2 7/2007 Yoshikawa et al.
7,276,929 B2 10/2007 Arai et al.
7,317,396 B2 1/2008 Ujino
7,405,664 B2 7/2008 Sakama et al.
7,519,328 B2 * 4/2009 Dokai et al. ..... 455/41.2
2002/0011967 A1 1/2002 Goff et al.
2002/0015002 A1 2/2002 Yasukawa et al.
2002/0044092 A1 4/2002 Kushihi
2002/0067316 A1 6/2002 Yokoshima et al.
2002/0093457 A1 7/2002 Hamada et al.
2003/0006901 A1 1/2003 Kim et al.
2003/0020661 A1 1/2003 Sato
2003/0045324 A1 3/2003 Nagumo et al.
2003/0169153 A1 9/2003 Muller
2004/0001027 A1 1/2004 Killen et al.
2004/0026519 A1 2/2004 Usami et al.
2004/0056823 A1 3/2004 Zuk et al.
2004/0066617 A1 4/2004 Hirabayashi et al.
2004/0217915 A1 11/2004 Imaizumi
2004/0219956 A1 11/2004 Iwai et al.
2004/0227673 A1 11/2004 Iwai et al.
2004/0252064 A1 12/2004 Yuanzhu
2005/0092836 A1 5/2005 Kudo
2005/0099337 A1 5/2005 Takei et al.
2005/0125093 A1 6/2005 Kikuchi et al.
2005/0134460 A1 6/2005 Usami
2005/0134506 A1 6/2005 Egbert
2005/0138798 A1 6/2005 Sakama et al.
2005/0140512 A1 6/2005 Sakama et al.
2005/0232412 A1 10/2005 Ichihara et al.
2005/0236623 A1 10/2005 Takechi et al.
2005/0275539 A1 12/2005 Sakama et al.
2006/0001138 A1 1/2006 Sakama et al.
2006/0032926 A1 2/2006 Baba et al.
2006/0044192 A1 3/2006 Egbert
2006/0055601 A1 3/2006 Kameda et al.
2006/0071084 A1 4/2006 Detig et al.
2006/0109185 A1 5/2006 Iwai et al.
2006/0145872 A1 7/2006 Tanaka et al.
2006/0158380 A1 7/2006 Son et al.
2006/0170606 A1 8/2006 Yamagajo et al.
2006/0214801 A1 9/2006 Murofushi et al.
2006/0220871 A1 10/2006 Baba et al.
2006/0244676 A1 11/2006 Uesaka
2006/0267138 A1 11/2006 Kobayashi
2007/0004028 A1 1/2007 Lair et al.
2007/0018893 A1 1/2007 Kai et al.
2007/0040028 A1 2/2007 Kawamata
2007/0052613 A1 3/2007 Gallschuetz et al.
2007/0057854 A1 3/2007 Oodachi et al.
2007/0069037 A1 3/2007 Kawai
2007/0132591 A1 6/2007 Khatri
2007/0164414 A1 7/2007 Dokai et al.
2007/0200782 A1 8/2007 Hayama et al.
2007/0229276 A1 10/2007 Yamagajo et al.
2007/0247387 A1 10/2007 Kubo et al.
2007/0252700 A1 11/2007 Ishihara et al.
2007/0252703 A1 11/2007 Kato et al.
2007/0285335 A1 12/2007 Bungo et al.
2007/0290928 A1 12/2007 Chang et al.
2008/0024156 A1 1/2008 Arai et al.
2008/0070003 A1 3/2008 Nakatani et al.
2008/0087990 A1 4/2008 Kato et al.
2008/0143630 A1 6/2008 Kato et al.
2008/0169905 A1 7/2008 Slatter
2008/0272885 A1 11/2008 Atherton
2009/0002130 A1 1/2009 Kato
2009/0009007 A1 1/2009 Kato et al.
2009/0021352 A1 1/2009 Kataya et al.
2009/0021446 A1 1/2009 Kataya et al.
2009/0065594 A1 3/2009 Kato et al.
2009/0109102 A1 4/2009 Dokai et al.
2009/0160719 A1 6/2009 Kato et al.
2009/0201116 A1 8/2009 Orihara
2009/0224061 A1 9/2009 Kato et al.
2009/0231106 A1 9/2009 Okamura
2009/0262041 A1 10/2009 Ikemoto et al.
2009/0266900 A1 10/2009 Ikemoto et al.
2009/0278687 A1 11/2009 Kato
2009/0321527 A1 12/2009 Kato et al.
2010/0103058 A1 4/2010 Kato et al.
2011/0031320 A1 2/2011 Kato et al.
2011/0063184 A1 3/2011 Furumura et al.

FOREIGN PATENT DOCUMENTS

EP 0 694 874 A2 1/1996
EP 0 848 448 A2 6/1998
EP 0 948 083 A2 10/1999
EP 0 977 145 A2 2/2000
EP 1 010 543 A1 6/2000
EP 1 160 915 A2 12/2001
EP 1 170 795 A2 1/2002
EP 1 193 793 A2 4/2002
EP 1 227 540 A1 7/2002
EP 1 280 232 A1 1/2003
EP 1 280 350 A1 1/2003
EP 1 343 223 A1 9/2003
EP 1 357 511 A2 10/2003
EP 1 547 753 A1 6/2005
EP 1 548 872 A1 6/2005
EP 1 703 589 A1 9/2006
EP 1 744 398 A1 1/2007
EP 1 841 005 A1 10/2007
EP 1 865 574 A1 12/2007
EP 1 976 056 A1 10/2008
EP 1 988 491 A1 11/2008
EP 1 993 170 A1 11/2008

(56) References Cited

FOREIGN PATENT DOCUMENTS

| | | | |
|---|---|---|---|
| EP | 2 009 738 | A1 | 12/2008 |
| EP | 2 012 258 | A1 | 1/2009 |
| EP | 2 148 449 | A1 | 1/2010 |
| EP | 2 251 934 | A1 | 11/2010 |
| GB | 2 305 075 | A | 3/1997 |
| GB | 2461443 | A | 1/2010 |
| JP | 50-143451 | A | 11/1975 |
| JP | 61-284102 | A | 12/1986 |
| JP | 62-127140 | U | 8/1987 |
| JP | 02-164105 | A | 6/1990 |
| JP | 02-256208 | A | 10/1990 |
| JP | 03-503467 | A | 8/1991 |
| JP | 03-262313 | A | 11/1991 |
| JP | 04-150011 | A | 5/1992 |
| JP | 04-167500 | A | 6/1992 |
| JP | 04-096814 | U | 8/1992 |
| JP | 04-101168 | U | 9/1992 |
| JP | 04-134807 | U | 12/1992 |
| JP | 05-327331 | A | 12/1993 |
| JP | 6-53733 | A | 2/1994 |
| JP | 06-077729 | A | 3/1994 |
| JP | 06-177635 | A | 6/1994 |
| JP | 6-260949 | A | 9/1994 |
| JP | 07-183836 | A | 7/1995 |
| JP | 08-055725 | A | 2/1996 |
| JP | 08-056113 | A | 2/1996 |
| JP | 8-87580 | A | 4/1996 |
| JP | 08-088586 | A | 4/1996 |
| JP | 08-88586 | A | 4/1996 |
| JP | 11-149537 | A | 6/1996 |
| JP | 08-176421 | A | 7/1996 |
| JP | 08-180160 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-035025 | A | 2/1997 |
| JP | 9-93029 | A | 4/1997 |
| JP | 09-093029 | A | 4/1997 |
| JP | 09-245381 | A | 9/1997 |
| JP | 09-252217 | A | 9/1997 |
| JP | 09-270623 | A | 10/1997 |
| JP | 09-284038 | A | 10/1997 |
| JP | 9-512367 | A | 12/1997 |
| JP | 10-069533 | A | 3/1998 |
| JP | 10-69533 | A | 3/1998 |
| JP | 10-505466 | A | 5/1998 |
| JP | 10-171954 | A | 6/1998 |
| JP | 10-173427 | A | 6/1998 |
| JP | 10-193849 | A | 7/1998 |
| JP | 10-193851 | A | 7/1998 |
| JP | 10-293828 | A | 11/1998 |
| JP | 11-025244 | A | 1/1999 |
| JP | 11-039441 | A | 2/1999 |
| JP | 11-075329 | A | 3/1999 |
| JP | 11-085937 | A | 3/1999 |
| JP | 11-88241 | A | 3/1999 |
| JP | 11-102424 | A | 4/1999 |
| JP | 11-103209 | A | 4/1999 |
| JP | 11-149536 | A | 6/1999 |
| JP | 11-149538 | A | 6/1999 |
| JP | 11-219420 | A | 8/1999 |
| JP | 11-220319 | A | 8/1999 |
| JP | 11-282993 | A | 10/1999 |
| JP | 11-328352 | A | 11/1999 |
| JP | 11-331014 | A | 11/1999 |
| JP | 11-346114 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2005-229474 | A | 1/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-222540 | A | 8/2000 |
| JP | 2000-510271 | A | 8/2000 |
| JP | 2000-242754 | A | 9/2000 |
| JP | 2000-243797 | A | 9/2000 |
| JP | 2000-251049 | A | 9/2000 |
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 3075400 | U | 11/2000 |
| JP | 2000-349680 | A | 12/2000 |
| JP | 2001-10264 | A | 1/2001 |
| JP | 2001-028036 | A | 1/2001 |
| JP | 2007-18067 | A | 1/2001 |
| JP | 2001-043340 | A | 2/2001 |
| JP | 2001-66990 | A | 3/2001 |
| JP | 2001-76111 | A | 3/2001 |
| JP | 2001-101369 | A | 4/2001 |
| JP | 2001-505682 | A | 4/2001 |
| JP | 2001-168628 | A | 6/2001 |
| JP | 2001-188890 | A | 7/2001 |
| JP | 2001-240046 | A | 9/2001 |
| JP | 2001-256457 | A | 9/2001 |
| JP | 2001-257292 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351083 | A | 12/2001 |
| JP | 2001-351084 | A | 12/2001 |
| JP | 2001-352176 | A | 12/2001 |
| JP | 2002-024776 | A | 1/2002 |
| JP | 2002-026513 | A | 1/2002 |
| JP | 2002-32731 | A | 1/2002 |
| JP | 2002-042076 | A | 2/2002 |
| JP | 2002-063557 | A | 2/2002 |
| JP | 2002-505645 | A | 2/2002 |
| JP | 2002-76750 | A | 3/2002 |
| JP | 2002-076750 | A | 3/2002 |
| JP | 2002-111363 | A | 4/2002 |
| JP | 2002-150245 | A | 5/2002 |
| JP | 2002-157564 | A | 5/2002 |
| JP | 2002-158529 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |
| JP | 2002-232221 | A | 8/2002 |
| JP | 2002-252117 | A | 9/2002 |
| JP | 2002-259934 | A | 9/2002 |
| JP | 2002-280821 | A | 9/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-362613 | A | 12/2002 |
| JP | 2002-366917 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |

(56) References Cited

FOREIGN PATENT DOCUMENTS

| | | | |
|---|---|---|---|
| JP | 2003-022912 | A | 1/2003 |
| JP | 2003-026177 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-529163 | A | 9/2003 |
| JP | 2003-288560 | A | 10/2003 |
| JP | 2003-309418 | A | 10/2003 |
| JP | 2003-317060 | A | 11/2003 |
| JP | 2003-331246 | A | 11/2003 |
| JP | 2003-332820 | A | 11/2003 |
| JP | 2003-536302 | A | 12/2003 |
| JP | 2004-040597 | A | 2/2004 |
| JP | 2004-505481 | A | 2/2004 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |
| JP | 2004-127230 | A | 4/2004 |
| JP | 2004-140513 | A | 5/2004 |
| JP | 2004-213582 | A | 7/2004 |
| JP | 2004-519916 | A | 7/2004 |
| JP | 2004-234595 | A | 8/2004 |
| JP | 2004-253858 | A | 9/2004 |
| JP | 2004-527864 | A | 9/2004 |
| JP | 2004-280390 | A | 10/2004 |
| JP | 2004-282403 | A | 10/2004 |
| JP | 2004-287767 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-18156 | A | 1/2005 |
| JP | 2005-033461 | A | 2/2005 |
| JP | 2005-124061 | A | 5/2005 |
| JP | 2005-128592 | A | 5/2005 |
| JP | 2005-129019 | A | 5/2005 |
| JP | 2005-135132 | A | 5/2005 |
| JP | 2005-136528 | A | 5/2005 |
| JP | 2005-137032 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-192124 | A | 7/2005 |
| JP | 2005-210676 | A | 8/2005 |
| JP | 2005-210680 | A | 8/2005 |
| JP | 2005-217822 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-284352 | A | 10/2005 |
| JP | 2005-293537 | A | 10/2005 |
| JP | 2005-295135 | A | 10/2005 |
| JP | 2005-311205 | A | 11/2005 |
| JP | 2005-321305 | A | 11/2005 |
| JP | 2005-322119 | A | 11/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-013976 | A | 1/2006 |
| JP | 2006-13976 | A | 1/2006 |
| JP | 2006-025390 | A | 1/2006 |
| JP | 2006-031766 | A | 2/2006 |
| JP | 2006-033312 | A | 2/2006 |
| JP | 2006-39902 | A | 2/2006 |
| JP | 2006-039947 | A | 2/2006 |
| JP | 2006-42059 | A | 2/2006 |
| JP | 2006-42097 | A | 2/2006 |
| JP | 2006-053833 | A | 2/2006 |
| JP | 2006-67479 | A | 3/2006 |
| JP | 2006-72706 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-513594 | A | 4/2006 |
| JP | 2006-148462 | A | 6/2006 |
| JP | 2006-148518 | A | 6/2006 |
| JP | 2006-151402 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-237674 | A | 9/2006 |
| JP | 2006-270212 | A | 10/2006 |
| JP | 2006-270681 | A | 10/2006 |
| JP | 2006-270766 | A | 10/2006 |
| JP | 2006-285911 | A | 10/2006 |
| JP | 2006-295879 | A | 10/2006 |
| JP | 2006-302219 | A | 11/2006 |
| JP | 2006-309401 | A | 11/2006 |
| JP | 2006-311239 | A | 11/2006 |
| JP | 2006-323481 | A | 11/2006 |
| JP | 2006-339964 | A | 12/2006 |
| JP | 2007-007888 | A | 1/2007 |
| JP | 2007-13120 | A | 1/2007 |
| JP | 2007-28002 | A | 2/2007 |
| JP | 2007-043535 | A | 2/2007 |
| JP | 2007-048126 | A | 2/2007 |
| JP | 2007-65822 | A | 3/2007 |
| JP | 2007-79687 | A | 3/2007 |
| JP | 2007-81712 | A | 3/2007 |
| JP | 2007-096768 | A | 4/2007 |
| JP | 2007-102348 | A | 4/2007 |
| JP | 2007-116347 | A | 5/2007 |
| JP | 2007-122542 | A | 5/2007 |

(56) References Cited

FOREIGN PATENT DOCUMENTS

| | | | |
|---|---|---|---|
| JP | 2007-150642 | A | 6/2007 |
| JP | 2007-150868 | A | 6/2007 |
| JP | 2007-159083 | A | 6/2007 |
| JP | 2007-159129 | A | 6/2007 |
| JP | 2007-166133 | A | 6/2007 |
| JP | 2007-172369 | A | 7/2007 |
| JP | 2007-172527 | A | 7/2007 |
| JP | 2007-228325 | A | 9/2007 |
| JP | 2007-266999 | A | 10/2007 |
| JP | 2007-272264 | A | 10/2007 |
| JP | 2007-287128 | A | 11/2007 |
| JP | 2007-295557 | A | 11/2007 |
| JP | 2007-312350 | A | 11/2007 |
| JP | 2007-324865 | A | 12/2007 |
| JP | 2008-033716 | A | 2/2008 |
| JP | 2008-72243 | A | 3/2008 |
| JP | 2008-083867 | A | 4/2008 |
| JP | 2008-097426 | A | 4/2008 |
| JP | 4069958 | B2 | 4/2008 |
| JP | 2008-103691 | A | 5/2008 |
| JP | 2008-107947 | A | 5/2008 |
| JP | 2008-148345 | A | 6/2008 |
| JP | 2008-519347 | A | 6/2008 |
| JP | 2008-160874 | A | 7/2008 |
| JP | 2008-197714 | A | 8/2008 |
| JP | 2008-288915 | A | 11/2008 |
| JP | 11-175678 | A | 1/2009 |
| JP | 2009-017284 | A | 1/2009 |
| JP | 2009-25870 | A | 2/2009 |
| JP | 2009-27291 | A | 2/2009 |
| JP | 2009-044715 | A | 2/2009 |
| JP | 3148168 | U | 2/2009 |
| JP | 2009-182630 | A | 8/2009 |
| JP | 2010-009196 | A | 1/2010 |
| JP | 4609604 | B2 | 1/2011 |
| NL | 9100176 | A | 3/1992 |
| NL | 9100347 | A | 3/1992 |
| WO | 98/33142 | A1 | 7/1998 |
| WO | 99/67754 | A1 | 12/1999 |
| WO | 00/10122 | A2 | 2/2000 |
| WO | 01/95242 | A2 | 12/2001 |
| WO | 02/48980 | A1 | 6/2002 |
| WO | 02/61675 | A1 | 8/2002 |
| WO | 02/097723 | A1 | 12/2002 |
| WO | 03/079305 | A1 | 9/2003 |
| WO | 2004/036772 | A1 | 4/2004 |
| WO | 2004/070879 | A | 8/2004 |
| WO | 2004/072892 | A1 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/114821 | A1 | 11/2006 |
| WO | 2007/083574 | A1 | 7/2007 |
| WO | 2007/083575 | A1 | 7/2007 |
| WO | 2007/086130 | A1 | 8/2007 |
| WO | 2007/097385 | A1 | 8/2007 |
| WO | 2007/102360 | A1 | 9/2007 |
| WO | 2007/105348 | A1 | 9/2007 |
| WO | 2007/119310 | A1 | 10/2007 |
| WO | 2007/125683 | A1 | 11/2007 |
| WO | 2007/138857 | A1 | 12/2007 |
| WO | 2008/007606 | A | 1/2008 |
| WO | 2008/081699 | A1 | 7/2008 |
| WO | 2008/126458 | A1 | 10/2008 |
| WO | 2008/133018 | A1 | 11/2008 |
| WO | 2008/140037 | A1 | 11/2008 |
| WO | 2008/142957 | A1 | 11/2008 |
| WO | 2009/011144 | A1 | 1/2009 |
| WO | 2009/011376 | A1 | 1/2009 |
| WO | 2009/011400 | A1 | 1/2009 |
| WO | 2009/011423 | A1 | 1/2009 |
| WO | 2009/081719 | A1 | 7/2009 |
| WO | 2009/110381 | A1 | 9/2009 |

OTHER PUBLICATIONS

Kato: "Radio IC Device"; U.S. Appl. No. 13/080,775, filed Apr. 6, 2011.
Kato et al.: "Antenna and Wireless IC Device"; U.S. Appl. No. 13/083,626, filed Apr. 11, 2011.
Official Communication issued in International Patent Application No. PCT/JP2009/070617, mailed on Mar. 16, 2010.
Nagai, "Mounting Technique of RFID by Roll-To-Roll Process", Material Stage, Technical Information Institute Co., Ltd, vol. 7, No. 9, 2007, pp. 4-12.
Dokai et al.: "Wireless IC Device"; U.S. Application No. 13/088,480, filed Apr. 18, 2011.
Kate et al.: "High-Frequency Device and Wireless IC Device"; U.S. Appl. No. 13/094,928, filed Apr. 27, 2011.
Dokai et al.: "Wireless IC Device"; U.S. Appl. No. 13/099,392, filed May 3, 2011.
Kato et al.: "Radio Frequency IC Device"; U.S. Appl. No. 13/163,803, filed Jun. 20, 2011.
Official Communication issued in International Patent Application No. PCT/JP2010/050170, mailed on Apr. 13, 2010.
Official Communication issued in International Patent Application No. PCT/JP2010/051205, mailed on May 11, 2010.
Kato: "Wireless IC Device, Wireless IC Module and Method of Manufacturing Wireless IC Module"; U.S. Appl. No. 13/169,067, filed Jun. 27, 2011.
Kato et al.: "Antenna and Wireless IC Device"; U.S. Appl. No. 13/190,670, filed Jul. 26, 2011.
Shiroki et al.: "RFIC Chip Mounting Structure"; U.S. Appl. No. 13/223,429, filed Sep. 1, 2011.
Official Communication issued in International Patent Application No. PCT/JP2010/056559, mailed on Jul. 27, 2010.
Taniguchi et al.: "Antenna Device and Radio Frequency IC Device"; U.S. Appl. No. 13/232,102, filed Sep. 14, 2011.
Official Communication issued in International Patent Application No. PCT/JP2009/056934, mailed on Jun. 30, 2009.
Kato et al.: "Wireless IC Device"; U.S. Appl. No. 12/903,242, filed Oct. 13, 2010.
Kato et al.: "Wireless IC Device"; U.S. Appl. No. 12/940,103, filed Nov. 5, 2010.
Kato et al.: "Wireless IC Device System and Method of Determining Authenticity of Wireless IC Device"; U.S. Appl. No. 12/940,105, filed Nov. 5, 2010.
Official Communication issued in International Patent Application No. PCT/JP2009/059669, mailed on Aug. 25, 2009.
Official Communication issued in International Patent Application No. PCT/JP2009/062181, mailed on Oct. 13, 2009.
Official Communication issued in corresponding Japanese Application No. 2010-501323, mailed on Apr. 6, 2010.
Kato et al.: "Component of Wireless IC Device and Wireless IC Device"; U.S. Appl. No. 12/944,099, filed Nov. 11, 2010.
Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454; filed Dec. 3, 2010.
Ikemoto et al.:"Radio IC Device"; U.S. Appl. No. 12/981,582; filed Dec. 30, 2010.
Official Communication issued in International Patent Application No. PCT/JP2009/062801, mailed on Oct. 27, 2009.
Ikemoto et al.: "Wireless IC Device and Electronic Apparatus"; U.S. Appl. No. 13/022,695; filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Wireless IC Device"; U.S. Appl. No. 13/080,781, filed Apr. 6, 2011.
Official Communication issued in International Patent Application No. PCT/JP2008/063025, mailed on Aug. 12, 2008.
Kato et al.: "Wireless IC Device," U.S. Appl. No. 12/603,608, filed Oct. 22, 2009.
Kato et al.: "Wireless IC Device," U.S. Appl. No. 12/688,072, filed Jan. 15, 2010.

(56) References Cited

OTHER PUBLICATIONS

Official Communication issued in International Patent Application No. PCT/JP2009/053693, mailed on Jun. 9, 2009.
Kato: "Composite Antenna," U.S. Appl. No. 12/845,846, filed Jul. 29, 2010.
Official Communication issued in International Patent Application No. PCT/JP2009/053690, mailed on Jun. 2, 2009.
Kato et al.: "Radio Frequency IC Device and Radio Communication System," U.S. Appl. No. 12/859,340, filed Aug. 19, 2010.
Official Communication issued in International Patent Application No. PCT/JP2009/055758, mailed on Jun. 23, 2009.
Kato et al.: "Wireless IC Device," U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device," U.S. Appl. No. 12/861,945, filed Aug. 24, 2010.
Kato: "Wireless IC Device and Electromagnetic Coupling Module," U.S. Appl. No. 12/890,895; filed Sep. 27, 2010.
Official Communication issued in International Patent Application No. PCT/JP2009/059410, mailed on Aug. 4, 2009.
Kato et al.: "Wireless IC Device" U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.
Official Communication issued in International Patent Application No. PCT/JP2009/056698, mailed on Jul. 7, 2009.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.
Kato et al.: "Wireless IC Device"; U.S. Appl. No. 12/211,117, filed Sep. 16, 2008.
Kato et al.: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communication issued in International Application No. PCT/JP2008/050356, mailed on Mar. 25, 2008.
Osamura et al.: "Packaging Material With Electromagnetic Coupling Module," U.S. Appl. No. 12/536,669, filed Aug. 6, 2009.
Dokai et al.: "Wireless IC Device and Component for Wireless IC Device," U.S. Appl. No. 12/543,553, filed Aug. 19, 2009.
Shioya et al.: "Wireless IC Device," U.S. Appl. No. 12/551,037, filed Aug. 31, 2009.
Ikemoto: "Wireless IC Device and Manufacturing Method Thereof," U.S. Appl. No. 12/579,672, filed Oct. 15, 2009.
Official communication issued in International Application No. PCT/JP2008/058614, mailed on Jun. 10, 2008.
Official communication issued in counterpart International Application No. PCT/JP2008/071502, mailed Feb. 24, 2009.
Kato et al.: "Wireless IC Device and Manufacturing Method Thereof," U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device," U.S. Appl. No. 12/469,896, filed May 21, 2009.
Ikemoto et al.: "Wireless IC Device," U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.
Ikemoto et al.: "Wireless IC Device and Electronic Apparatus," U.S. Appl. No. 12/503,188, filed Jul. 15, 2009.
Official communication issued in counterpart International Application No. PCT/JP2008/055567, mailed May 20, 2008.
Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device," U.S. Appl. No. 12/510,338, filed Jul. 28, 2009.
Kato et al.: "Wireless IC Device," U.S. Appl. No. 12/510,340, filed Jul. 28, 2009.
Kato: "Wireless IC Device," U.S. Appl. No. 12/510,344, filed Jul. 28, 2009.
Kato et al.: "Wireless IC Device," U.S. Appl. No. 12/510,347, filed on Jul. 28, 2009.
Official Communication issued in International Patent Application No. PCT/JP2009/066336, mailed on Dec. 22, 2009.
Official Communication issued in corresponding Japanese Patent Application No. 2010-509439, mailed on Jul. 6, 2010.
Official Communication issued in corresponding Japanese Patent Application No. 2011-032311, mailed on Mar. 29, 2011.
Official Communication issued in corresponding Japanese Patent Application No. 2009-525327, drafted on Sep. 22, 2010.
Official Communication issued in corresponding Japanese Patent Application No. 2011-032311, mailed on Aug. 2, 2011.
Official Communication issued in corresponding Japanese Patent Application No. 2011-032312, mailed on Aug. 2, 2011.
Official Communication issued in corresponding Japanese Patent Application No. 2011-032311, mailed on Aug. 23, 2011.
Kato et al.: "Wireless IC Device Component and Wireless IC Device"; U.S. Appl. No. 13/241,823, filed Sep. 23, 2011.
Kato et al.: "Antenna Device and Method of Setting Resonant Frequency of Antenna Device"; U.S. Appl. No. 13/272,365, filed Oct. 13, 2011.
Official Communication issued in International Patent Application No. PCT/JP2010/056812, mailed on Jul. 13, 2010.
Dokai et al.: "Optical Disc"; U.S. Appl. No. 13/295,153, filed Nov. 14, 2011.
Official Communication issued in International Patent Application No. PCT/JP2010/057668, mailed on Aug. 17, 2010.

(56) References Cited

OTHER PUBLICATIONS

Osamura et al.: "Radio Frequency IC Device and Method of Manufacturing the Same"; U.S. Appl. No. 13/308,575, filed Dec. 1, 2011.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequency IC Devices and Method of Manufacturing Radio Frequency IC Devices Using the Same"; U.S. Appl. No. 12/388,826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no. Subete" "(All About Wireless IC Tags"), RFID, pp. 112-126.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399, mailed on Aug. 25, 2008.

* cited by examiner

WIRELESS IC DEVICE AND COUPLING METHOD FOR POWER FEEDING CIRCUIT AND RADIATION PLATE

BACKGROUND OF THE INVENTION

1. Field of the Invention

The present invention relates to a wireless IC device, and in particular, relates to a wireless IC device used for an RFID (Radio Frequency Identification) system and a coupling method for a power feeding circuit and a radiation plate included in the wireless IC device.

2. Description of the Related Art

In the past, as a management system for goods, there has been developed an RFID system in which communication between a reader/writer generating an induction electromagnetic field and a wireless tag (also referred to as a wireless IC device) storing therein predetermined information assigned to goods is established on the basis of a non-contact method and information is transmitted. As a wireless tag used for this type of RFID system, in Japanese Unexamined Patent Application Publication No. 10-293828, a data carrier is described that includes an IC circuit, a primary coil antenna, and a secondary coil antenna and causes the primary coil antenna and the secondary coil antenna to be electromagnetically coupled to each other.

However, in the above-mentioned data carrier, the degree of coupling between the primary coil antenna and the secondary coil antenna is small, and a coupling loss occurs. While it is possible to improve the degree of coupling of a magnetic field by increasing the inductance value of the secondary coil antenna, this results in the secondary coil antenna being large in size. In addition, since the coupling depends on a communication frequency, it is difficult to decrease the size of the secondary coil antenna. Furthermore, when both the antennas are also electric-field-coupled to each other, there occurs a problem that the degree of coupling is small, in the same way as described above.

SUMMARY OF THE INVENTION

Therefore, preferred embodiments of the present invention provide a wireless IC device capable of coupling a power feeding circuit including a wireless IC and a radiation plate with each other with a high degree of coupling and significantly decreasing the size of the radiation plate, and a coupling method for the power feeding circuit and the radiation plate.

A wireless IC device according to a preferred embodiment of the present invention includes a wireless IC, a power feeding circuit coupled with the wireless IC and including a resonant circuit and/or matching circuit including at least two inductance elements, and a radiation plate radiating a transmission signal supplied from the power feeding circuit and/or supplying a received signal to the power feeding circuit, wherein the at least two inductance elements have spiral shapes wound in directions opposite to each other and winding axes of the individual inductance elements are disposed at different positions, and the radiation plate includes two plate-shaped coupling units, and the plate-shaped coupling units are disposed in a vicinity of the at least two inductance elements so as to be nearly perpendicular to the winding axes of the inductance elements, respectively.

A wireless IC device according to another preferred embodiment of the present invention includes a wireless IC, a power feeding circuit coupled with the wireless IC and including a resonant circuit and/or matching circuit including at least two inductance elements, and a radiation plate radiating a transmission signal supplied from the power feeding circuit and/or supplying a received signal to the power feeding circuit, wherein the at least two inductance elements have spiral shapes wound in directions opposite to each other and the winding axes of the individual inductance elements are disposed at different positions, and the radiation plate includes two spiral-shaped coupling units, the spiral-shaped coupling units are disposed in a vicinity of the at least two inductance elements so that the spiral surfaces thereof are nearly perpendicular to the winding axes of the inductance elements, respectively, and the spiral-shaped coupling units are wound in directions opposite to the winding directions of the inductance elements adjacent to the spiral-shaped coupling units, respectively.

A coupling method for a power feeding circuit and a radiation plate according to another preferred embodiment of the present invention, is a coupling method for a power feeding circuit including a resonant circuit and/or matching circuit including at least two inductance elements and a radiation plate radiating a transmission signal supplied from the power feeding circuit and/or supplying a received signal to the power feeding circuit, wherein the at least two inductance elements have spiral shapes wound in directions opposite to each other and the winding axes of the individual inductance elements are disposed at different positions, the radiation plate includes two plate-shaped coupling units, and the two plate-shaped coupling units are disposed in a vicinity of the at least two inductance elements so as to be nearly perpendicular to the winding axes of the inductance elements, respectively, and eddy currents occur in the two plate-shaped coupling units so as to couple the power feeding circuit and the radiation plate with each other.

A coupling method for a power feeding circuit and a radiation plate according to yet another preferred embodiment of the present invention, is a coupling method for a power feeding circuit including a resonant circuit and/or matching circuit including at least two inductance elements and a radiation plate radiating a transmission signal supplied from the power feeding circuit and/or supplying a received signal to the power feeding circuit, wherein the at least two inductance elements have spiral shapes wound in directions opposite to each other and the winding axes of the individual inductance elements are disposed at different positions, the radiation plate includes two spiral-shaped coupling units, and the two spiral-shaped coupling units are disposed in a vicinity of the at least two inductance elements so that the spiral surfaces thereof are nearly perpendicular to the winding axes of the inductance elements, respectively, the spiral-shaped coupling units are wound in directions opposite to the winding directions of the inductance elements adjacent to the spiral-shaped coupling units, respectively, and eddy currents occur in the two spiral-shaped coupling units, thereby coupling the power feeding circuit and the radiation plate with each other.

In the wireless IC device and the coupling method according to first and third preferred embodiments of the present invention, since the plate-shaped coupling units in the radiation plate are disposed in a vicinity of the inductance elements so as to be nearly perpendicular to the winding axes of the inductance elements wound in directions opposite to each other, eddy currents occur in the two plate-shaped coupling units. The directions of the eddy currents are opposite to each other in the two plate-shaped coupling units, and a current flows through the radiation plate. More specifically, the power feeding circuit and the radiation plate are coupled with each other owing to the eddy currents. Since, in such coupling due to the eddy currents, the degree of coupling is high and the coupling does not depend on a communication frequency, the size of the radiation plate may be small.

In the wireless IC device and the coupling method according to the second and fourth preferred embodiments of the present invention, the spiral-shaped coupling units in the radiation plate are disposed in a vicinity of the inductance elements so that the spiral surfaces thereof are nearly perpendicular to the winding axes of the inductance elements wound in directions opposite to each other, and the spiral-shaped coupling units are wound in directions opposite to the winding directions of the inductance elements adjacent to the spiral-shaped coupling units, respectively. Therefore, eddy currents occur in the two spiral-shaped coupling units. The directions of the eddy currents are opposite to each other in the two spiral-shaped coupling units, and a current flows through the radiation plate. More specifically, the power feeding circuit and the radiation plate are coupled with each other owing to the eddy currents. Since, in such coupling due to the eddy currents, the degree of coupling is high and the coupling does not depend on a communication frequency, the size of the radiation plate may be small.

According to various preferred embodiments of the present invention, it is possible to couple the power feeding circuit including the wireless IC and the radiation plate with each other with the high degree of coupling due to eddy currents, and since the coupling does not depend on a frequency, it is possible to significantly decrease the size the radiation plate.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of a wireless IC device and a coupling method according to the present invention will be described with reference to accompanying drawings.

First Preferred Embodiment

Figure 1:
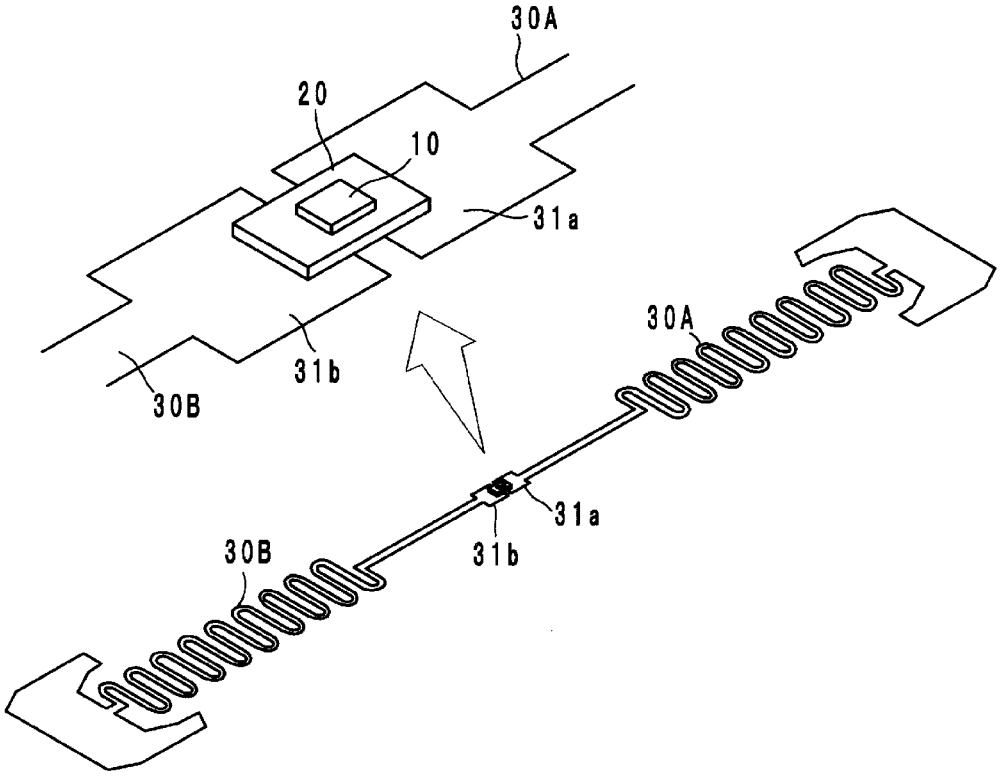
FIG. 1 is a perspective view illustrating a wireless IC device according to a first preferred embodiment of the present invention.
Figure 2:
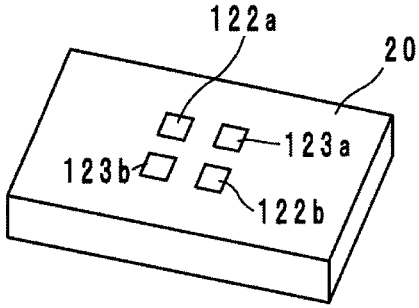
FIG. 2 is a perspective view illustrating a power feeding circuit substrate configuring the wireless IC device according to the first preferred embodiment of the present invention.

A wireless IC device that is a first preferred embodiment is a device used in a UHF band, and, as illustrated in FIG. 1, includes a wireless IC chip 10 processing a transmission/reception signal of a predetermined frequency, a power feeding circuit substrate 20 mounted with the wireless IC chip 10, and two radiation plates 30A and 30B.

Figure 4:
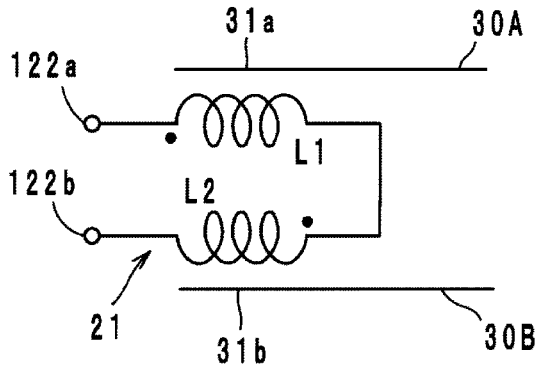
FIG. 4 is an equivalent circuit diagram including a power feeding circuit and a radiation plate according to the first preferred embodiment of the present invention.

As illustrated as an equivalent circuit in FIG. 4, the power feeding circuit substrate 20 includes a power feeding circuit 21 including a resonant circuit/matching circuit in which inductance elements L1 and L2 are included that have substantially the same inductance values and preferably have spiral shapes wound in directions opposite to each other. The winding axes of the inductance elements L1 and L2 are disposed at different positions and parallel or substantially parallel to each other, in plan view.

The wireless IC chip 10 includes a clock circuit, a logic circuit, a memory circuit, and the like, necessary information is stored therein, and a pair of input-output terminal electrodes and a pair of mounting terminal electrodes, not illustrated, are provided on the rear surface thereof. The input-output terminal electrodes are electrically connected to power feeding terminal electrodes 122*a* and 122*b* located on the power feeding circuit substrate 20 through metal bumps or the like, and the mounting terminal electrodes are electrically connected to mounting electrodes 123*a* and 123*b* through metal bumps or the like, for example. In addition, it may be that the wireless IC chip 10 and the power feeding circuit 21 are not electrically connected to each other, and are coupled (electromagnetically coupled) with each other.

The radiation plates 30A and 30B preferably are individually arranged to have meander shapes on a flexible resin film (not illustrated), and include non-magnetic metal material.

End portions of the radiation plates 30A and 30B are regarded as plate-shaped coupling units 31*a* and 31*b*, and the power feeding circuit substrate 20 is stuck onto the coupling units 31*a* and 31*b*. More specifically, the plate-shaped coupling unit 31*a* is disposed in a vicinity of the inductance element L1 so as to be perpendicular or substantially perpendicular to the winding axis of the inductance element L1, and the plate-shaped coupling unit 31*b* is disposed in a vicinity of the inductance element L2 so as to be perpendicular to the winding axis of the inductance element L2. In addition, it is desirable that the sizes of the plate-shaped coupling units 31*a* and 31*b* are large enough to cover the aperture planes of coil patterns configuring the inductance elements L1 and L2.

The inductance elements L1 and L2 included in the power feeding circuit 21 are magnetically coupled with each other in a reverse phase to resonate with a frequency processed by the wireless IC chip 10, and coupled with the coupling units 31*a* and 31*b* in the radiation plates 30A and 30B owing to eddy currents, in such a way as described later. In addition, the power feeding circuit 21 establishes matching between the impedance of the wireless IC chip 10 and the impedances of the radiation plates 30A and 30B. The inductance values of the inductance elements L1 and L2 may be different from each other, or may be substantially equal to each other. When the inductance value of the inductance elements L1 and L2 are caused to be substantially equal to each other, the leakage magnetic field of a closed loop is reduced, and it is possible to reduce a coupling loss.

Here, the coupling between the power feeding circuit 21 and the radiation plates 30A and 30B will be described with reference to FIGS. 5A-5F. First, since the inductance elements L1 and L2 are wound in directions opposite to each other (refer to FIG. 5A) and the current paths thereof are mirror-reversed, magnetic fields are also reversed, and a far magnetic field becomes zero. Therefore, the power feeding circuit substrate 20 does not function as an antenna. In addition, since the elements L1 and L2 are wound in directions opposite to each other, a magnetic field flows as one closed loop, and does not leak to the outside (refer to FIG. 5B). Accordingly, a portion of energy is not radiated further other than coupling as in normal magnetic field coupling.

Figure 5A:
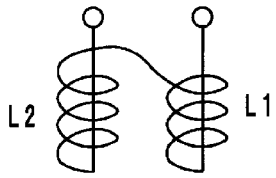
FIGS. 5A-5F are explanatory diagrams illustrating a coupling method for the power feeding circuit and the radiation plate according to the first preferred embodiment of the present invention.
Figure 5D:
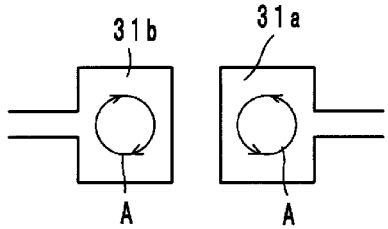
Figure 5B:
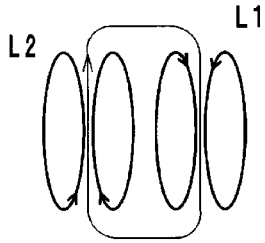
Figure 5E:
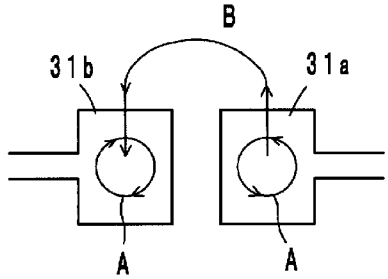
Figure 5C:
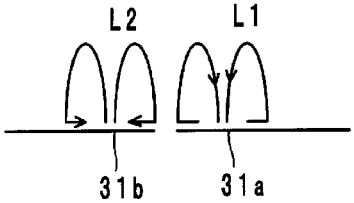
Figure 5F:
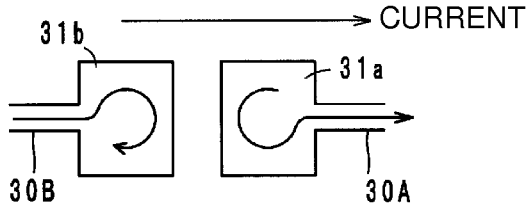

When focusing attention on the plate-shaped coupling units 31*a* and 31*b* facing the inductance elements L1 and L2, since magnetic fields occurring from the elements L1 and L2 perpendicularly affect the coupling units 31*a* and 31*b* (refer to FIG. 5C), eddy currents A occur in the coupling units 31*a* and 31*b* (refer to FIG. 5D). Directions in which the eddy currents A flow are opposite to each other in the adjacent plate-shaped coupling units 31*a* and 31*b*, magnetic fields occurring from the eddy currents A define one closed loop, and a secondary magnetic field B causing the magnetic fields to draw close to each other occurs (refer to FIG. 5E). Electrons for the neutralization of a magnetic field attempt to flow from one end portion to the other end portion with originating from the secondary magnetic field B. In addition, even if the radiation plates 30A and 30B are separated into two portions, currents flow into and from the adjacent coupling units 31*a* and 31*b* from and to the outside, and currents flow through the radiation plates 30A and 30B (refer to FIG. 5F).

In addition, as in a second preferred embodiment illustrated below (refer to FIG. 8), a current also flows through a loop-shaped radiation plate 30. In this way, in a coupling method utilizing eddy currents, the path length of a radiation plate is not influenced. In addition, that a radiation plate is divided into two plates or is one loop-shaped plate does not influence a coupling efficiency. In this regard, however, when the path lengths of the radiation plates 30A and 30B area about $\lambda/4$ (a total path length is about $\lambda/2$), a voltage becomes a maximum and a current becomes a minimum at an end portion, and a resonance condition is satisfied. Therefore, it is easier for a current to flow.

More specifically, owing to a magnetic field generated by adjacent eddy currents, eddy currents flow through the radiation plates 30A and 30B with originating from the facing plate-shaped coupling units 31*a* and 31*b*. In this way, unlike magnetic field coupling or electric field coupling of the related art, a magnetic field perpendicularly runs into the plate-shaped coupling units 31*a* and 31*b*, thereby actively generating eddy currents, and hence energy causing a current to flow through the radiation plates 30A and 30B occurs with originating from adjacent eddy currents. Such transmission (coupling) of energy is realized when a plate perpendicularly or substantially perpendicularly facing a pair of coils whose directions are opposite to each other is disposed and eddy currents flows through the plate. Accordingly, even if a plate-shaped coupling unit is only disposed for one of the inductance elements L1 and L2, it is difficult to transmit energy to the radiation plate.

The above-mentioned new coupling method based on the eddy currents does not depend on a frequency if a magnetic field is strong, and in an HF band such as 13.56 MHz or the like which is a low frequency, it is also possible to couple the power feeding circuit 21 with the radiation plates 30A and 30B. Also in a high-frequency wave, an efficiency of transmitting energy to the radiation plates 30A and 30B is high, and even the small power feeding circuit substrate 20 can realize a degree of coupling ranging from about 0.8 to about 1.0 (specifically, greater than or equal to about 0.96) with respect to the plate-shaped coupling units 31*a* and 31*b*, for example. The degree of coupling is a value converted on the basis of a minimum driving power that is about −14.7 dBm at the time of direct coupling in which the power feeding circuit 21 is DC-connected to the radiation plates 30A and 30B and about −11.5 dBm at the time of the present coupling due to the eddy currents. As a reason that a slight coupling loss occurs in this experiment, the resistance component and the dielectric loss (tan $\delta$) of the coil-shaped electrode pattern may be considered. In addition, the deviations of the inductance values of the inductance elements L1 and L2 also causes the occurrence of the leakage magnetic field of the closed loop, and causes a coupling loss.

Accordingly, the power feeding circuit 21 transmits, to the radiation plates 30A and 30B, a transmission signal having a predetermined frequency, transmitted from the wireless IC chip 10, and selects a reception signal having a predetermined frequency from a signal received by the radiation plates 30A and 30B to supply the selected signal to the wireless IC chip 10. Therefore, in the wireless IC device, the wireless IC chip 10 is caused to operate by the signal received by the radiation plates 30A and 30B, and a response signal from the wireless IC chip 10 is radiated from the radiation plates 30A and 30B to the outside.

As described above, in the present wireless IC device, the frequency of the signal is set by the power feeding circuit 21 provided in the power feeding circuit substrate 20. Therefore, even if the present wireless IC device is attached to various kinds of goods, the present wireless IC device operates without change, the fluctuation of a radiation characteristic is suppressed, and it is not necessary to perform the design change of the radiation plates 30A and 30B or the like, with respect to individual goods. In addition, the frequency of the transmission signal radiated from the radiation plates 30A and 30B and the frequency of the reception signal supplied to the wireless IC chip 10 substantially correspond to the resonance frequency of the power feeding circuit 21 in the power feeding circuit substrate 20, and the maximum gain of a signal is substantially determined by at least one of the size and the shape of the power feeding circuit 21, a distance between the power feeding circuit and the radiation plates 30A and 30B, and a medium. Since the frequency of the transmission/reception signal is determined in the power feeding circuit substrate 20, without depending on the shapes and the sizes of the radiation plates 30A and 30B, a disposition relationship therebetween, or the like, it is possible to obtain a stable frequency characteristic without the frequency characteristic being changed, even if the wireless IC device is rolled or sandwiched between dielectric materials, for example.

Figure 3:
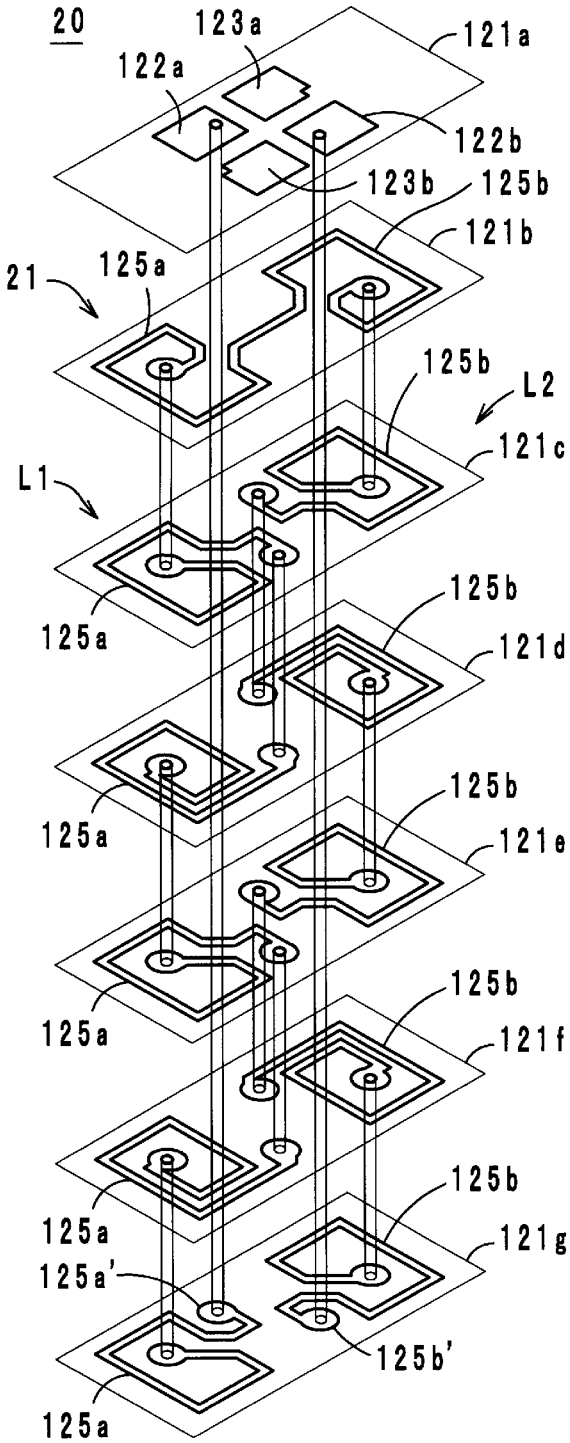
FIG. 3 is a perspective view illustrating a laminated structure of the power feeding circuit substrate illustrated in FIG. 2.

Here, the configuration of the power feeding circuit substrate 20 will be described with reference to FIG. 3. The power feeding circuit substrate 20 is preferably obtained by laminating, crimping, and firing ceramic sheets 121*a* to 121*g* including dielectric material or magnetic material, for example. The power feeding terminal electrodes 122*a* and 122*b* and the mounting electrodes 123*a* and 123*b* are located on the sheet 121*a* in an uppermost layer, and wiring electrodes 125*a* and 125*b* are located on the sheet 121*b* to 121*g*.

The inductance elements L1 and L2 are formed preferably by individually connecting the wiring electrodes 125*a* and 125*b* having spiral shapes through via hole conductors, and integrated using the wiring electrodes 125*a* and 125*b* on the sheet 121*b*. An end portion 125*a*' of the wiring electrode 125*a* on the sheet 121*g* is connected to the power feeding terminal electrode 122*a* through a via hole conductor, and an end portion 125*b*' of the wiring electrode 125*b* on the sheet 121*g* is connected to the power feeding terminal electrode 122*b* through a via hole conductor.

Figure 6:
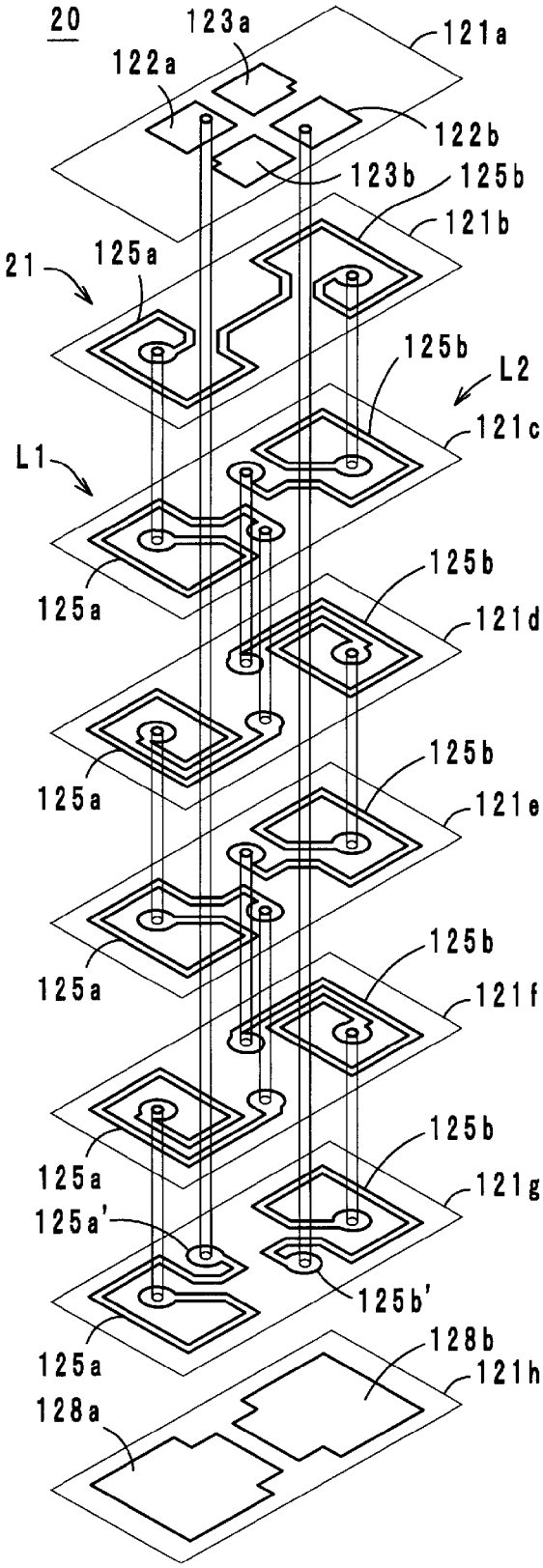
FIG. 6 is a perspective view illustrating a laminated structure of an example of a modification to the power feeding circuit substrate.
Figure 7:
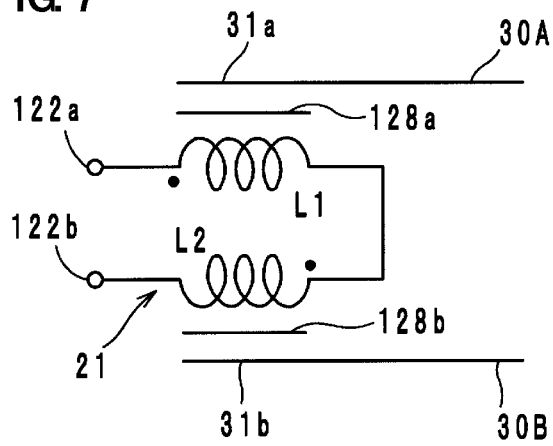
FIG. 7 is an equivalent circuit diagram including an example of a modification to the power feeding circuit substrate, illustrated in FIG. 6, and the radiation plate.

FIG. 6 illustrates an example of a modification to the power feeding circuit substrate 20. The power feeding circuit substrate 20 is obtained preferably by providing the sheet 121*h* in the lowermost layer of the laminated structure illustrated in FIG. 3 and forming flat electrodes 128*a* and 128*b* on the sheet 121*h*. FIG. 7 illustrates the equivalent circuit thereof.

Even if the flat electrodes 128*a* and 128*b* are caused to lie between the inductance elements L1 and L2 and the plate-shaped coupling units 31*a* and 31*b*, the coupling between the inductance elements L1 and L2 and the radiation plates 30A and 30B is the same as described above. While eddy currents are generated in the flat electrodes 128*a* and 128*b*, magnetic fields from the inductance elements L1 and L2 are also transmitted to the plate-shaped coupling units 31*a* and 31*b* adjacent to the flat electrodes 128*a* and 128*b*. More specifically, each of a pair of the flat electrode 128*a* and the plate-shaped coupling unit 31*a* and a pair of the flat electrode 128*b* and the plate-shaped coupling unit 31*b* functions as a plate blocking a magnetic field. Accordingly, currents flow through the radiation plates 30A and 30B. In addition, the flat electrodes 128*a* and 128*b* may be formed on the outer surface (the rear surface of the sheet 121*h*) of the power feeding circuit substrate 20. By forming the flat electrodes 128*a* and 128*b* on the outer surface, it is possible to use the flat electrodes 128*a* and 128*b* as mounting electrodes.

Second Preferred Embodiment

Figure 8:
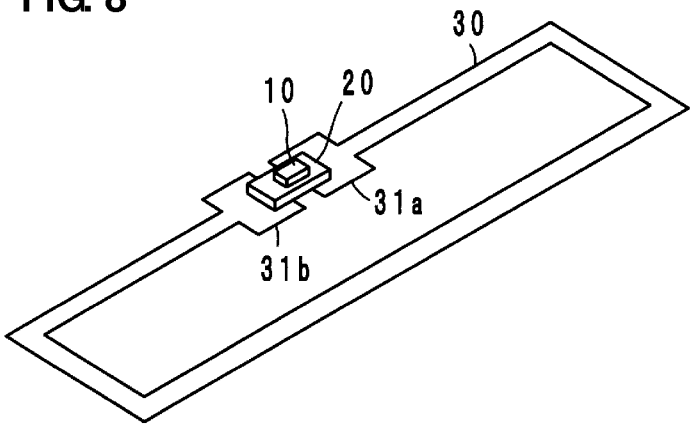
FIG. 8 is a perspective view illustrating a wireless IC device according to a second preferred embodiment of the present invention.

As illustrated in FIG. 8, in a wireless IC device according to a second preferred embodiment of the present invention, a radiation plate 30 including the plate-shaped coupling units 31*a* and 31*b* is loop-shaped, and the other components are preferably the same as those of the first preferred embodiment. The plate-shaped coupling units 31*a* and 31*b* are perpendicularly or substantially perpendicularly disposed in a vicinity of the inductance elements L1 and L2 wound in directions opposite to each other, and hence the power feeding circuit 21 is coupled with the plate-shaped coupling units 31*a* and 31*b* owing to eddy currents, and a current flows through the loop-shaped radiation plate 30. This is the same as described in the first preferred embodiment.

Figure 10:
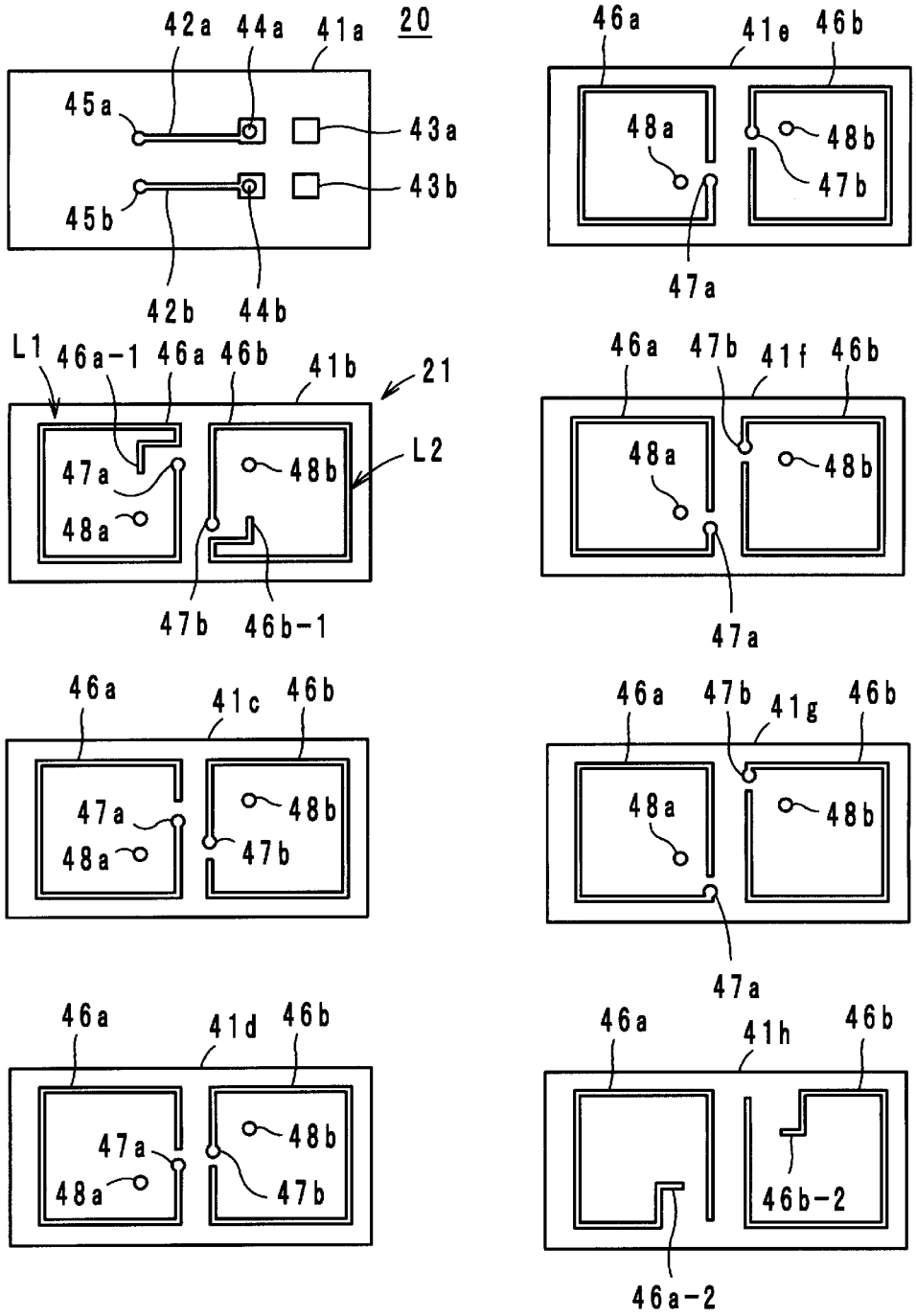
FIG. 10 is a plan view illustrating a laminated structure of the power feeding circuit substrate according to the second preferred embodiment of the present invention.
Figure 11:
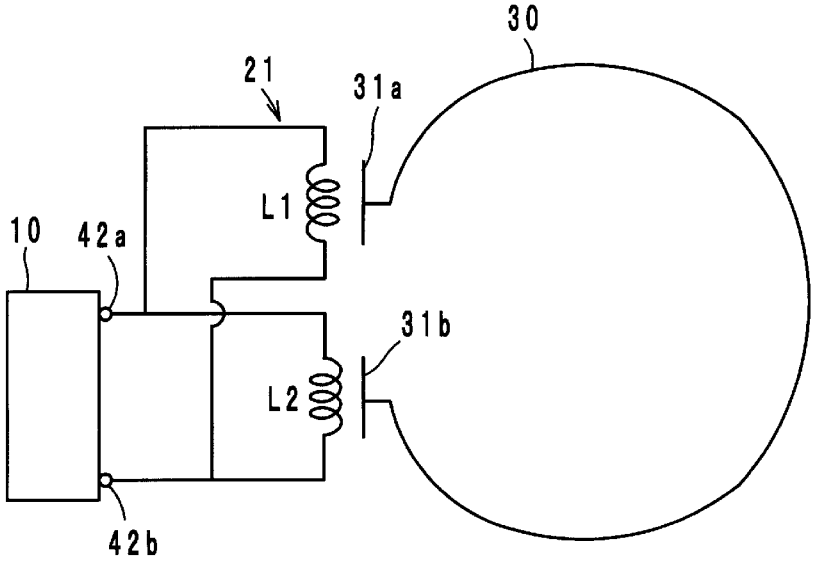
FIG. 11 is an equivalent circuit diagram including a power feeding circuit and a radiation plate according to the second preferred embodiment of the present invention.

FIG. 11 illustrates an equivalent circuit in the present second preferred embodiment. In addition, as the power feeding circuit substrate 20, a power feeding circuit substrate having a laminated structure illustrated in FIG. 10 is preferably used. More specifically, the power feeding circuit substrate 20 is obtained preferably by laminating, crimping, and firing ceramic sheets 41*a* to 41*h* including dielectric material or magnetic material. Power feeding terminal electrodes 42*a* and 42*b*, mounting electrodes 43*a* and 43*b*, and via hole conductors 44*a*, 44*b*, 45*a*, and 45*b* are formed on the sheet 41*a* in an uppermost layer. Wiring electrodes 46*a* and 46*b* configuring the inductance elements L1 and L2 are formed on each of the sheet 41*b* in a second layer to the sheet 41*h* in an eighth layer, and via hole conductors 47*a*, 47*b*, 48*a*, and 48*b* are formed when necessary.

By laminating the above-mentioned sheets 41*a* to 41*h*, the inductance element L1 is located where the wiring electrodes 46*a* are connected in a spiral shape through the via hole conductor 47*a*, and the inductance element L2 is located where the wiring electrodes 46*b* are connected in a spiral shape through the via hole conductor 47*b*. In addition, capacitance is generated between the lines of the wiring electrodes 46*a* and 46*b*.

An end portion 46*a*-1 of the wiring electrode 46*a* on the sheet 41*b* is connected to the power feeding terminal electrode 42*a* through the via hole conductor 45*a*, and an end portion 46*a*-2 of the wiring electrode 46*a* on the sheet 41*h* is connected to the power feeding terminal electrode 42*b* through the via hole conductors 48*a* and 45*b*. An end portion 46*b*-1 of the wiring electrode 46*b* on the sheet 41*b* is connected to the power feeding terminal electrode 42*b* through the via hole conductor 44*b*, and an end portion 46*b*-2 of the wiring electrode 46*b* on the sheet 41*h* is connected to the power feeding terminal electrode 42*a* through the via hole conductors 48*b* and 44*a*.

Figure 9:
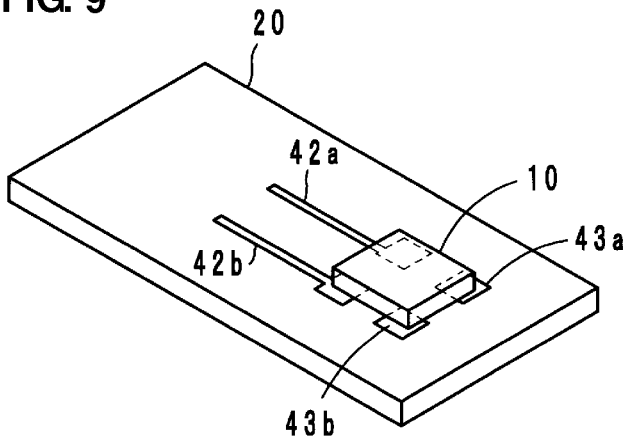
FIG. 9 is a perspective view illustrating a power feeding circuit substrate and a wireless IC chip, which configure the wireless IC device according to the second preferred embodiment of the present invention.

As illustrated in FIG. 9, the power feeding terminal electrodes 42*a* and 42*b* are electrically connected to the input-output terminal electrodes in the wireless IC chip 10, and the mounting electrodes 43*a* and 43*b* are electrically connected to mounting terminal electrode in the wireless IC chip 10.

Figure 12:
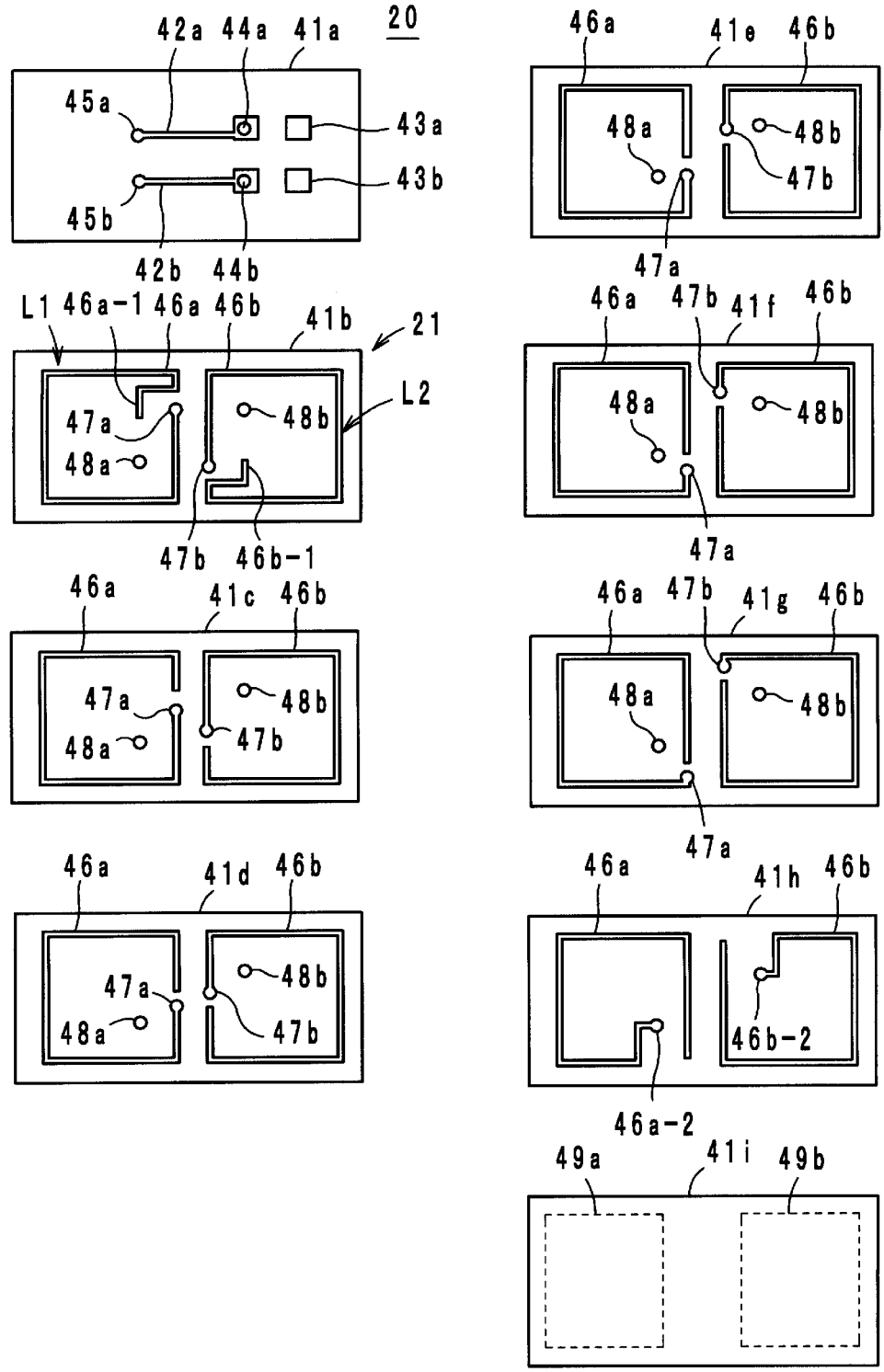
FIG. 12 is a plan view illustrating a laminated structure of an example of a modification to the power feeding circuit substrate.
Figure 13:
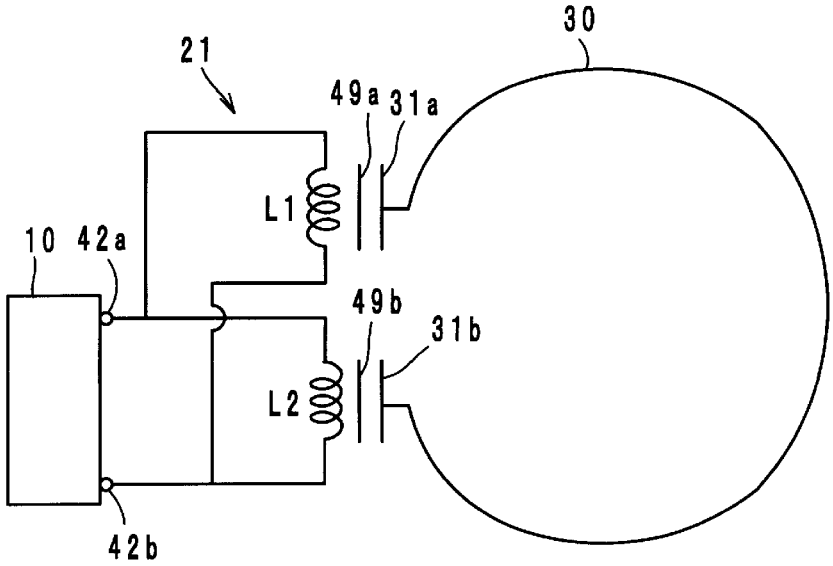
FIG. 13 is an equivalent circuit diagram including an example of a modification to the power feeding circuit substrate, illustrated in FIG. 12, and the radiation plate.

FIG. 12 illustrates an example of a modification to the power feeding circuit substrate 20, and FIG. 13 illustrates the equivalent circuit thereof. The power feeding circuit substrate 20 is obtained preferably by providing flat electrodes 49*a* and 49*b* on the rear surface of the sheet 41*i* provided in the lowermost layer of the power feeding circuit substrate 20 illustrated in FIG. 10, the outer shapes of the flat electrodes 49*a* and 49*b* being equal to or smaller than those of the inductance elements L1 and L2 when the perspective plane of the power feeding circuit substrate 20 is viewed.

Even if the flat electrodes 49*a* and 49*b* are caused to lie between the inductance elements L1 and L2 and the plate-shaped coupling units 31*a* and 31*b*, the coupling between the inductance elements L1 and L2 and the radiation plate 30 is the same as described above. While eddy currents are generated in the flat electrodes 49*a* and 49*b*, magnetic fields from the inductance elements L1 and L2 are also transmitted to the plate-shaped coupling units 31*a* and 31*b* adjacent to the flat electrodes 49*a* and 49*b*. More specifically, each of a pair of the flat electrode 49*a* and the plate-shaped coupling unit 31*a* and a pair of the flat electrode 49*b* and the plate-shaped coupling unit 31*b* functions as a plate blocking a magnetic field. Accordingly, a current flows through the radiation plate 30.

In the above-mentioned individual preferred embodiments, a case in which the end portions of the inductance elements L1 and L2 are connected to each other (refer to FIG. 3 and FIG. 4), and a case in which the inductance elements L1 and L2 are connected in parallel to the wireless IC chip 10 using the power feeding terminal electrodes 42*a* and 42*b* (refer to FIG. 10 and FIG. 11) have been illustrated. When the end portions of the inductance elements L1 and L2 are connected in series to each other, the amount of a flowing current becomes larger, and the amount of a magnetic field also becomes larger. Therefore, it is possible to further enhance the degree of coupling.

Figure 14:
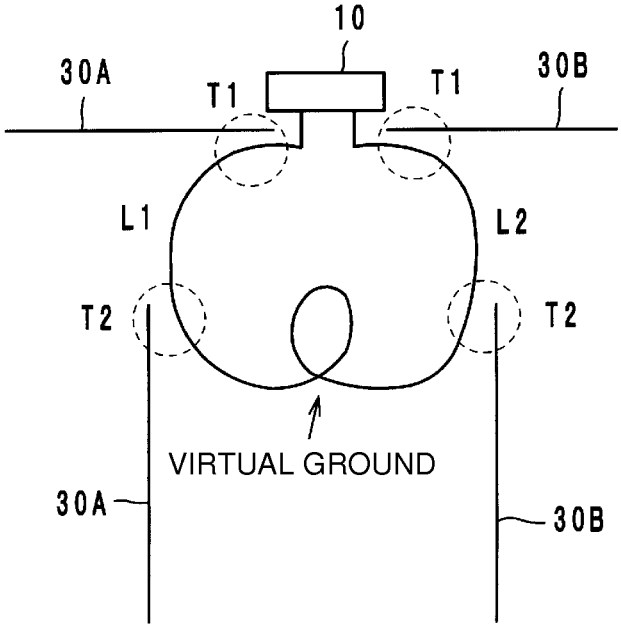
FIG. 14 is a pattern diagram for explaining the change of impedance of the radiation plate.

Incidentally, by changing distances of coupling portions from virtual ground with respect to the inductance elements L1 and L2 as illustrated in FIG. 14, it is possible to change the impedances of the radiation plates 30A and 30B. When coupling portions are far from the virtual ground as coupling portions T1, the impedances of the radiation plates 30A and 30B become large. When coupling portions get near to the virtual ground as coupling portions T2, the impedances of the radiation plates 30A and 30B become small. Such changes of the coupling portions can be performed by changing an interlayer connection relationship between coil-shaped wiring electrodes configuring the inductance elements L1 and L2.

Third Preferred Embodiment

Figure 15:
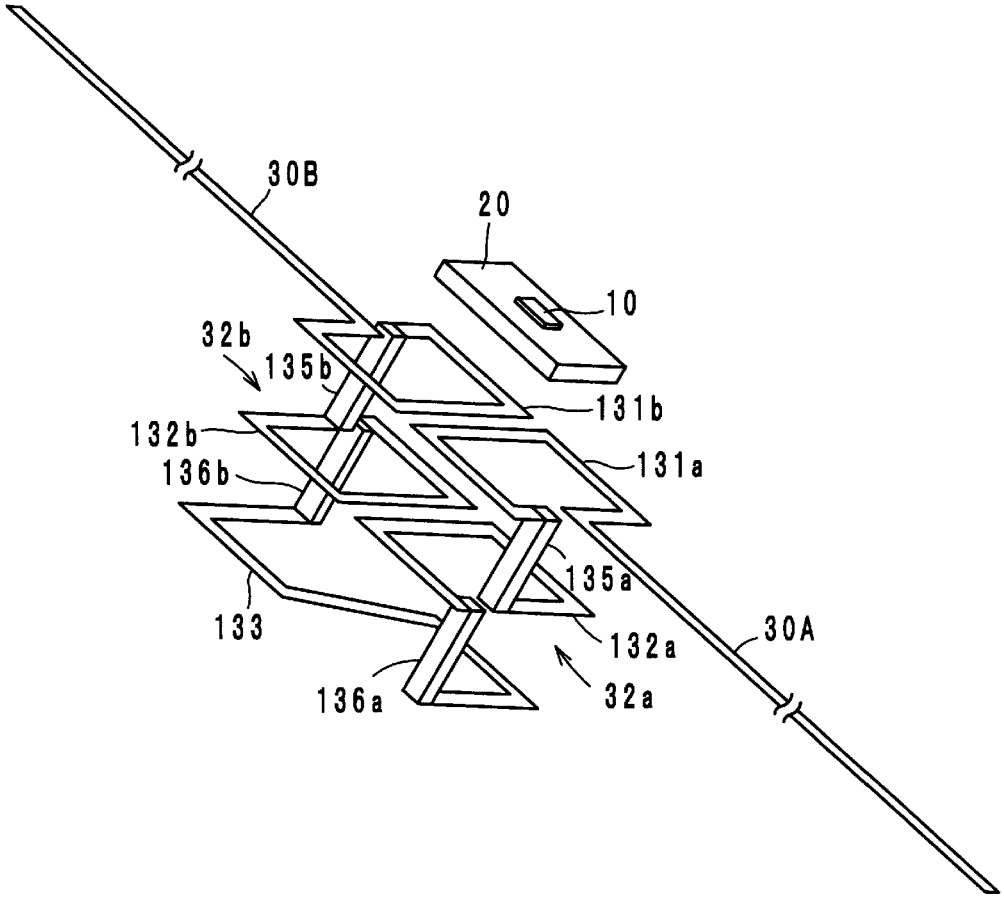
FIG. 15 is a perspective view illustrating a wireless IC device according to a third preferred embodiment of the present invention.

As illustrated in FIG. 15, a wireless IC device according to a third preferred embodiment includes a wireless IC chip 10, a power feeding circuit substrate 20 mounted with the wireless IC chip 10, and two linear radiation plates 30A and 30B. The power feeding circuit substrate 20 is preferably the same as that illustrated in the first preferred embodiment (with respect to the inner structure, refer to FIG. 3, for example).

End portions of the radiation plates 30A and 30B are preferably spiral-shaped coupling units 32*a* and 32*b*, respectively. The spiral-shaped coupling units 32*a* and 32*b* are disposed in a vicinity of the two inductance elements L1 and L2 (refer to the first preferred embodiment) so that the spiral surfaces thereof are perpendicular or substantially perpendicular to the winding axes of the inductance elements L1 and L2, respectively, and the spiral-shaped coupling units 32*a* and 32*b* are wound in directions opposite to the winding directions of the adjacent inductance elements L1 and L2, respectively. More specifically, the inductance elements L1 and L2 are coupled with the spiral-shaped coupling units 32*a* and 32*b* owing to eddy currents, as described below.

Here, coupling between the power feeding circuit 21 and the radiation plates 30A and 30B will be described with reference to FIGS. 17A-17E and FIGS. 18A-18C. First, since the inductance elements L1 and L2 are wound in directions opposite to each other (refer to FIG. 17A, and the current paths are mirror-reversed, magnetic fields are also reversed, and a far magnetic field becomes zero. Therefore, the power feeding circuit substrate 20 does not function as an antenna. In addition, since the elements L1 and L2 are wound in directions opposite to each other, a magnetic field flows as one closed loop, and does not leak to the outside (refer to FIG. 17B). A closed magnetic circuit is formed in such a way, and hence a portion of energy is not radiated further other than coupling as in usual magnetic field coupling.

Figure 17A:
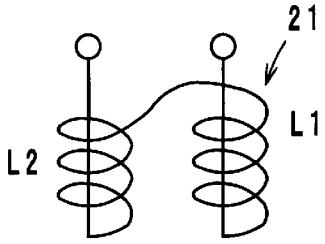
FIGS. 17A-17E are explanatory diagrams illustrating a coupling method for the power feeding circuit and the radiation plate according to the third preferred embodiment of the present invention.
Figure 17C:
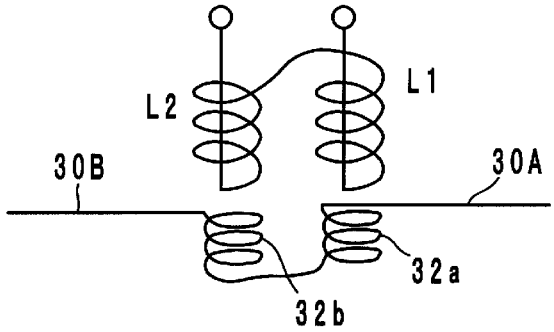
Figure 17B:
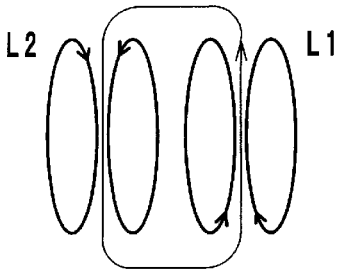
Figure 17D:
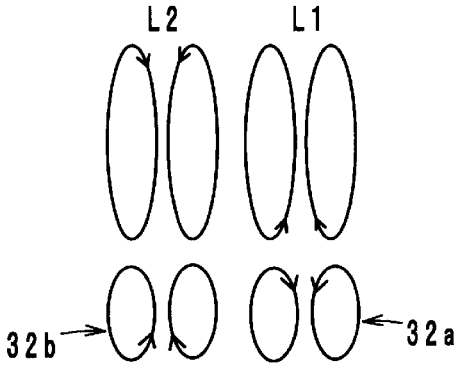
Figure 17E:
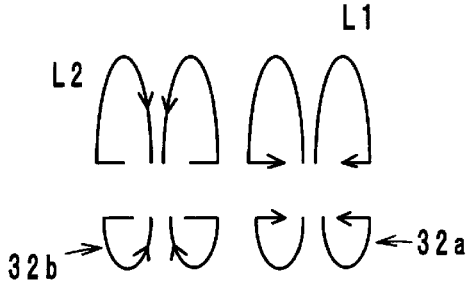
Figure 18A:
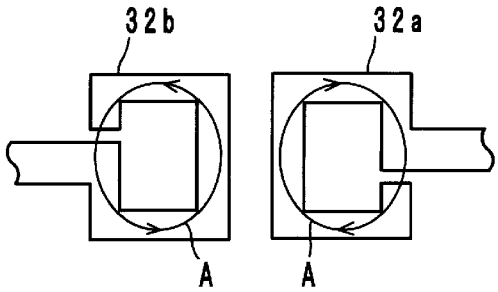
FIGS. 18A-18C are explanatory diagrams illustrating a coupling method for the power feeding circuit and the radiation plate according to the third preferred embodiment of the present invention and the continuation of FIGS. 17A-17E.
Figure 18B:
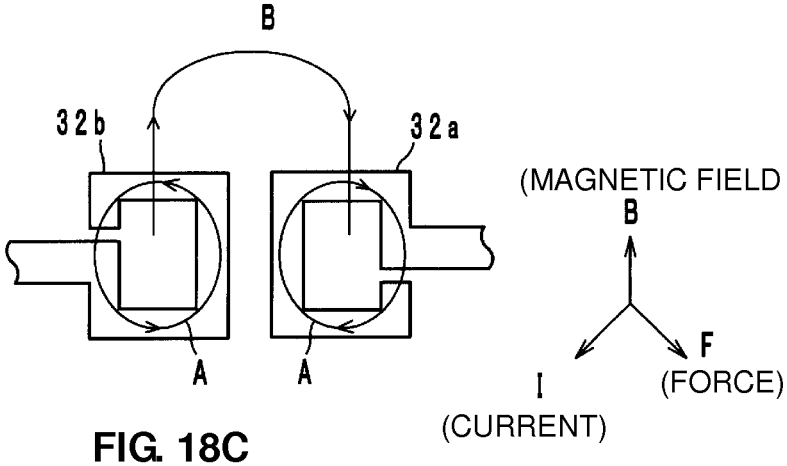
Figure 18C:
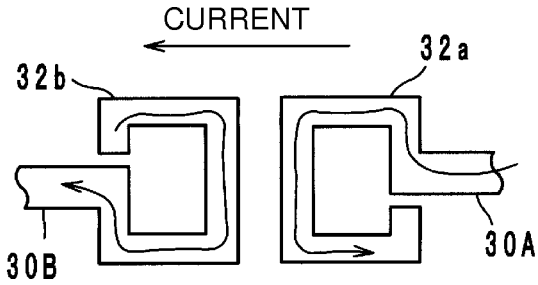

As illustrated in FIG. 17C, when focusing attention on the spiral-shaped coupling units 32*a* and 32*b* facing the inductance elements L1 and L2, magnetic fields are generated in the coupling units 32*a* and 32*b*, the directions of the magnetic fields being opposite to those of magnetic fields formed by the elements L1 and L2 facing the coupling units 32*a* and 32*b*, respectively (refer to FIG. 17D, and the magnetic fields of the elements L1 and L2 are blocked out (refer to FIG. 17E). Since the coupling units 32*a* and 32*b* are also wound in directions opposite to each other, the directions of magnetic fields individually occurring in the coupling units 32*a* and 32*b* are opposite to each other. Owing to the magnetic fields, eddy currents A occur in the coupling units 32*a* and 32*b* (refer to FIG. 18A). Since the coupling units 32*a* and 32*b* are adjacent to each other and directions in which the eddy currents A flow are opposite to each other in adjacent portions, a closed-loop secondary magnetic field B occurs (refer to FIG. 18B). Electrons for the neutralization of a magnetic field attempt to flow from one end portion to the other end portion with originating from the secondary magnetic field B. In addition, even if the radiation plates 30A and 30B are separated into two portions, currents flow into and from the adjacent coupling units 32*a* and 32*b* from and to the outside, and currents flow through the radiation plates 30A and 30B (refer to FIG. 18C).

In other words, the coupling units 32*a* and 32*b* receive the magnetic field B, and a current I occurs and receives a force F. In each of the coupling units 32*a* and 32*b*, since the directions of the magnetic field B and the current I are reversed, the force F received by electrons turns out to have the same direction, as the radiation plates 30A and 30B, and currents turn out to flow through the radiation plates 30A and 30B.

A function in which the spiral-shaped coupling units 32*a* and 32*b* are coupled with each other owing to eddy currents and the effects thereof are the same as described in the eddy current coupling of the plate-shaped coupling units 31*a* and 31*b*. Accordingly, the description of a function effect in the first preferred embodiment is also applied to the present third preferred embodiment of the present invention.

Here, the laminated structures of the spiral-shaped coupling units 32*a* and 32*b* will be described with reference to FIG. 15 and FIG. 16. End portions of the radiation plates 30A and 30B are connected to end portions of the loop-shaped wiring electrodes 131*a* and 131*b*, respectively, and the other end portions of the electrodes 131*a* and 131*b* are connected to end portions of loop-shaped wiring electrodes 132*a* and 132*b* in the second layer through via hole conductors 135*a* and 135*b*. The other end portions of the electrodes 132*a* and 132*b* are connected to a wiring electrode 133 in the third layer through via hole conductors 136*a* and 136*b*. The spiral-shaped coupling units 32*a* and 32*b* are interlinked through the electrode 133, and the radiation plates 30A and 30B turn out to be formed using one conductive wire. If the wavelength of a signal is $\lambda$, it is desirable that the lengths of such radiation plates 30A and 30B are the integral multiple of $\lambda/2$.

Figure 16:
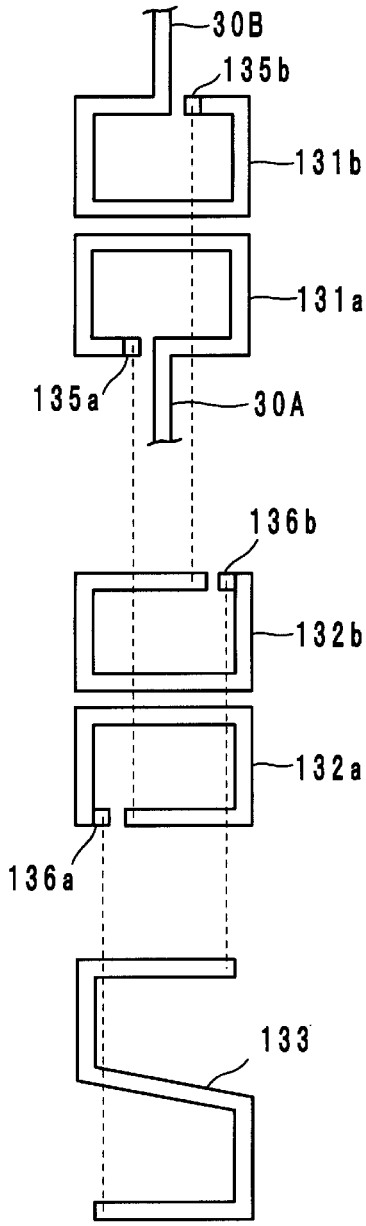
FIG. 16 is an exploded plan view illustrating a structure of a radiation plate according to the third preferred embodiment of the present invention.

In addition, in FIG. 15 and FIG. 16, the spiral-shaped coupling units 32*a* and 32*b* have been illustrated preferably as structures in which wiring electrodes are formed and laminated in a substrate. However, in addition to this, the spiral-shaped coupling units 32*a* and 32*b* may also be configured by shaping a copper line into a spiral shape.

Other Preferred Embodiments

In addition, the wireless IC device and the coupling method according to the present invention are not limited to the above-mentioned preferred embodiments, and it should be understood that various other preferred embodiments, and combinations and modifications thereof may occur insofar as they are within the scope thereof.

For example, the wireless IC may not be a chip type, and may be formed in the power feeding circuit substrate in an integrated fashion. In addition, various shapes may be adopted for the radiation plate.

The individual radiation plates and the individual power feeding circuit substrates that have been illustrated in the above-mentioned preferred embodiments and examples of modifications may be arbitrarily combined. In addition, it should be understood that the configuration of the power feeding circuit is not limited to the above-mentioned preferred embodiments.

As described above, preferred embodiments of the present invention are useful for a wireless IC device, and in particular, are superior in terms of being capable of coupling a power feeding circuit with a radiation plate with a very high degree of coupling due to eddy currents.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A wireless IC device, comprising a wireless IC;

a power feeding circuit coupled with the wireless IC and including a resonant circuit and/or a matching circuit including at least two inductance elements; and a radiation plate arranged to radiate a transmission signal supplied from the power feeding circuit and/or supply a received signal to the power feeding circuit; wherein the at least two inductance elements are spiral shaped and wound in directions opposite to each other and winding axes of each of the at least two individual inductance elements are disposed at different positions; and the radiation plate includes two spiral-shaped coupling units, the spiral-shaped coupling units are disposed in a vicinity of the at least two inductance elements so that spiral surfaces thereof are nearly perpendicular to the winding axes of the at least two inductance elements, respectively, and the spiral-shaped coupling units are wound in directions opposite to the winding directions of the at least two inductance elements adjacent to the spiral-shaped coupling units, respectively.

2. The wireless IC device according to claim 1, wherein the radiation plate includes one conductive wire.

3. The wireless IC device according to claim 1, wherein a length of the radiation plate is an integral multiple of $\lambda/2$.

4. A coupling method for a power feeding circuit including a resonant circuit and/or a matching circuit including at least two inductance elements and a radiation plate arranged to radiate a transmission signal supplied from the power feeding circuit and/or supply a received signal to the power feeding circuit; wherein the at least two inductance elements are spiral shaped and wound in directions opposite to each other and winding axes of the at least two inductance elements are disposed at different positions;

the radiation plate includes two spiral-shaped coupling units; and the two spiral-shaped coupling units are disposed in a vicinity of the at least two inductance elements so that spiral surfaces thereof are nearly perpendicular to the winding axes of the at least two inductance elements, respectively, the spiral-shaped coupling units are wound in directions opposite to the winding directions of the inductance elements adjacent to the spiral-shaped coupling units, respectively, and eddy currents are caused to occur in the two spiral-shaped coupling units so as to couple the power feeding circuit and the radiation plate with each other.

* * * * *